US007317885B2

(12) United States Patent
Adachi et al.

(10) Patent No.: US 7,317,885 B2
(45) Date of Patent: Jan. 8, 2008

(54) IMAGE FORMING APPARATUS MOUNTED WITH AN OPEN AND CLOSE UNIT

(75) Inventors: Takefumi Adachi, Saitama (JP); Kazuhiko Imamura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/253,664

(22) Filed: Oct. 20, 2005

(65) Prior Publication Data

US 2006/0093396 A1 May 4, 2006

(30) Foreign Application Priority Data

Oct. 20, 2004 (JP) ..... 2004-305141
Jun. 20, 2005 (JP) ..... 2005-179586

(51) Int. Cl.
*G03G 15/00* (2006.01)

(52) U.S. Cl. ..... 399/107; 399/364

(58) Field of Classification Search ..... 399/107, 399/364, 124
See application file for complete search history.

(56) References Cited

U.S. PATENT DOCUMENTS

| | | | | |
|---|---|---|---|---|
| 4,866,482 | A | 9/1989 | Hirasawa et al. | |
| 5,815,772 | A * | 9/1998 | Saito et al. | 399/107 |
| 5,839,032 | A | 11/1998 | Yasui et al. | |
| 6,215,970 | B1 * | 4/2001 | Yoshikawa et al. | 399/124 |
| 2001/0033393 | A1 | 10/2001 | Adachi | |
| 2002/0114634 | A1 | 8/2002 | Ahn et al. | |
| 2003/0108368 | A1 * | 6/2003 | Omata et al. | 399/309 |
| 2004/0182048 | A1 | 9/2004 | Matsumoto et al. | |
| 2005/0002682 | A1 * | 1/2005 | Lyu et al. | 399/107 |
| 2005/0089315 | A1 | 4/2005 | Imamura et al. | |

FOREIGN PATENT DOCUMENTS

| | | | |
|---|---|---|---|
| JP | 08-328451 | | 12/1996 |
| JP | 10161507 | A * | 6/1998 |
| JP | 11-314780 | | 11/1999 |
| JP | 2003-302800 | | 10/2003 |

OTHER PUBLICATIONS

U.S. Appl. No. 08/038,834, filed Mar. 29, 1993, Nakazato et al.
U.S. Appl. No. 09/791,797, filed Feb. 26, 2001, Adachi.
U.S. Appl. No. 10/743,865, filed Dec. 24, 2003, Matsumoto et al.
U.S. Appl. No. 10/934,960, filed Sep. 20, 2004, Imamura et al.

* cited by examiner

*Primary Examiner*—David M. Gray
*Assistant Examiner*—Erika J. Villaluna
(74) *Attorney, Agent, or Firm*—Oblon, Spivak, McClelland, Maier & Neustadt, P.C.

(57) ABSTRACT

An image forming apparatus includes a first frame plate and a second frame plate, which has an extended portion horizontally extending by a predetermined length compared with the first frame plate. The first and second frame plates are oppositely disposed spaced apart by a predetermined width from each other. An open and close unit, which includes a recording medium conveying system, is disposed within an area of the extended portion between the first and second frame plates and is configured to freely open and close with respect to the image forming apparatus. And a drive controlling mechanism is configured to control the recording medium conveying system. The extended portion supports at least a portion of the drive controlling mechanism so as to be separately mounted on a side of the image forming apparatus.

24 Claims, 9 Drawing Sheets

IMAGE FORMING APPARATUS MOUNTED WITH AN OPEN AND CLOSE UNIT

CROSS REFERENCE TO RELATED APPLICATIONS

The present application claims priority to Japanese patent application no. 2004-305141, filed in the Japan Patent Office on Oct. 20, 2004, and Japanese patent application no. 2005-179586, filed in the Japan Patent Office on Jun. 20, 2005, the disclosures of which are hereby incorporated by reference herein in their entirety.

BACKGROUND OF THE INVENTION

1. Field of the Invention

The present invention relates to an image forming apparatus that makes use of an electrophotographic process, such as a copier, printer, facsimile machine, or multifunctional machine including functions of the copier, printer, and/or facsimile machine. More specifically, the present invention relates to an image forming apparatus having image forming units between a pair of frame plates oppositely disposed to each other so that a toner image formed on an image bearing member may be transferred onto a recording medium.

2. Discussion of the Background

As shown in FIG. 1, a background image forming apparatus 100 includes a main body 101, an image scanning mechanism 102 arranged above the main body 101, an automatic document feeder (ADF) 103 arranged above the image scanning mechanism 102, and a duplex print unit 104 at the right-hand side of the main body 102 of the image forming apparatus 100 of FIG. 1.

The main body 101 of the image forming apparatus 100 includes a sheet feeding mechanism 105, an image forming mechanism 106 arranged above the sheet feeding mechanism 105, a sheet discharging portion 107 arranged above the image forming mechanism 106, and a sheet conveying path 108.

The image forming mechanism 106 disposed in the main body 101 of the image forming apparatus 100 may be supported by a pair of frame plates (not shown) oppositely disposed to each other at front and rear sides of the image forming apparatus 100.

To record image data of an image from an original document to a recording medium, the original document is fed through the ADF 103 to the image scanning mechanism 102. The image scanning mechanism 102 reads the image data of the original document to form an image in the image forming mechanism 106 according to image data signals. While the image forming mechanism 106 forms the image, a recording medium is fed from one of sheet feeding cassettes in the sheet feeding mechanism 105, and is conveyed upward through the sheet conveying path 108 to the main body 101 of the image forming apparatus 100. After the image formed by the image forming mechanism 106 is transferred onto the recording medium, the recording medium is discharged to the sheet discharging portion 107.

To form images on both sides of a recording medium, a first image is formed as described above. A second image is formed such that the recording medium having a first image on one side thereof is conveyed to the duplex print unit 104, is reversed to the different surface side orientation, and is supplied to the image forming mechanism 106 of the main body 101 again. After the second image formed by the image forming mechanism 106 is transferred onto the rear side of the recording medium, the recording medium is discharged to the sheet discharging portion 107.

In recent years, however, making duplex copies has been encouraged from a view point of effective utilization of resources. For example, the image forming apparatus 100 as shown in FIG. 1 may have the duplex print unit 104 to perform a duplex print operation so that images may be formed on both sides of the recording medium. With the above-described structure, the duplex print unit 104 mounted to the image forming apparatus 100 has a longer path for conveying the recording medium and/or may handle different types or sizes of papers such as recycled papers, the quality of which may be degraded. Under the above-described conditions that the duplex print operation is performed with the duplex print unit 104, a paper jam is more likely to occur.

When the paper jam occurs in the image forming apparatus 100 of FIG. 1, the duplex print unit 104 is rotated about a lower portion thereof to open the duplex print unit 104 facing upward as shown in FIG. 2. An inner cover 109 is then rotated about a lower potion thereof to open to face upward, as shown in FIG. 3, so as to remove a jammed recording paper p.

In the above-described background image forming apparatus 100, the duplex print unit 104 may include a conveying member such as a roller for conveying a reversed recording medium having an image on one side thereof, a guiding member for guiding the reversed recording medium, a switching member such as a path selector for switching or selecting a direction of the reversed recording medium, and so on. The duplex print unit 104 may further include a drive source such as a drive motor for rotating the conveying member, a solenoid for switching the switching member, and a detecting member for detecting the recording medium during the travel thereof. By including the above-described members and units, the duplex print unit 104 tends to become large and heavy, which may cause poor operability of opening and closing the duplex print unit 104 when a paper jam occurs.

To solve the above-described problem, some background image forming apparatuses have been provided with, for example, a damper mechanism and/or a spring to improve the operability of opening and closing the duplex print unit 104. Such a structure of the image forming apparatus 100, however, has a complicated construction, resulting in increase of costs.

SUMMARY OF THE INVENTION

The present invention has been made in view of the above-mentioned circumstances.

An object of the present invention is to provide a novel image forming apparatus capable of effectively improving operability of an open and close unit included in the novel image forming apparatus.

Another object of the present invention is to provide a novel method of mounting the open and close unit on the above-described novel fixing device.

In one embodiment, a novel image forming apparatus includes first and second frame plates, an open and close unit, and a drive controlling mechanism. The first and second frame plates are oppositely disposed spaced apart by a predetermined width from each other, and the second frame plate includes an extended portion horizontally extending by a predetermined length compared with the first frame plate. The open and close unit is disposed within an area of the extended portion between the first and second frame plates and is configured to freely open and close with respect to the novel image forming apparatus. The open and close unit includes a recording medium conveying system configured to convey a recording medium. The drive controlling mechanism is configured to control the recording medium conveying system. The extended portion supports a portion of the drive controlling mechanism so as to be separately mounted on a side of the novel image forming apparatus.

Further, in one embodiment, a novel method of mounting an open and close unit on an image forming apparatus includes disposing first and second frame plates oppositely spaced apart by a predetermined width from each other, the second frame plate comprising an extended portion horizontally extending by a predetermined length compared with the first frame plate, mounting an open and close unit within an area of the extended portion between the first and second frame plates and configured to freely open and close with respect to the image forming apparatus, the open and close unit comprising a recording medium conveying system configured to convey a recording medium, and mounting a portion of a drive controlling mechanism configured to control the recording medium conveying system so that the portion of the drive controlling mechanism is supported separately from the open and close unit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
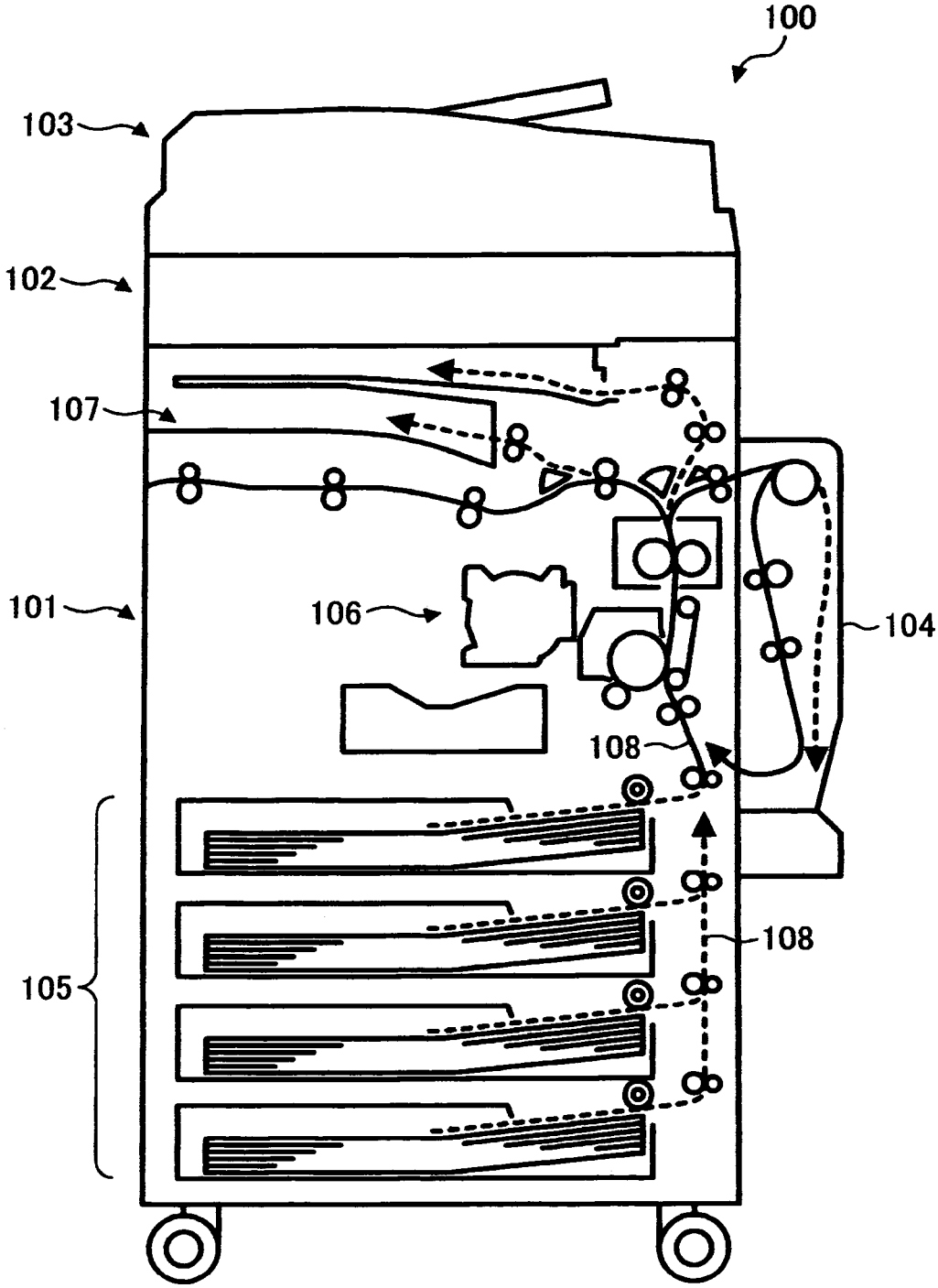
FIG. 1 BACKGROUND ART
FIG. 1 is a schematic structure of a background tandem-type electrophotographic image forming apparatus including an indirect transfer system.
Figure 2:
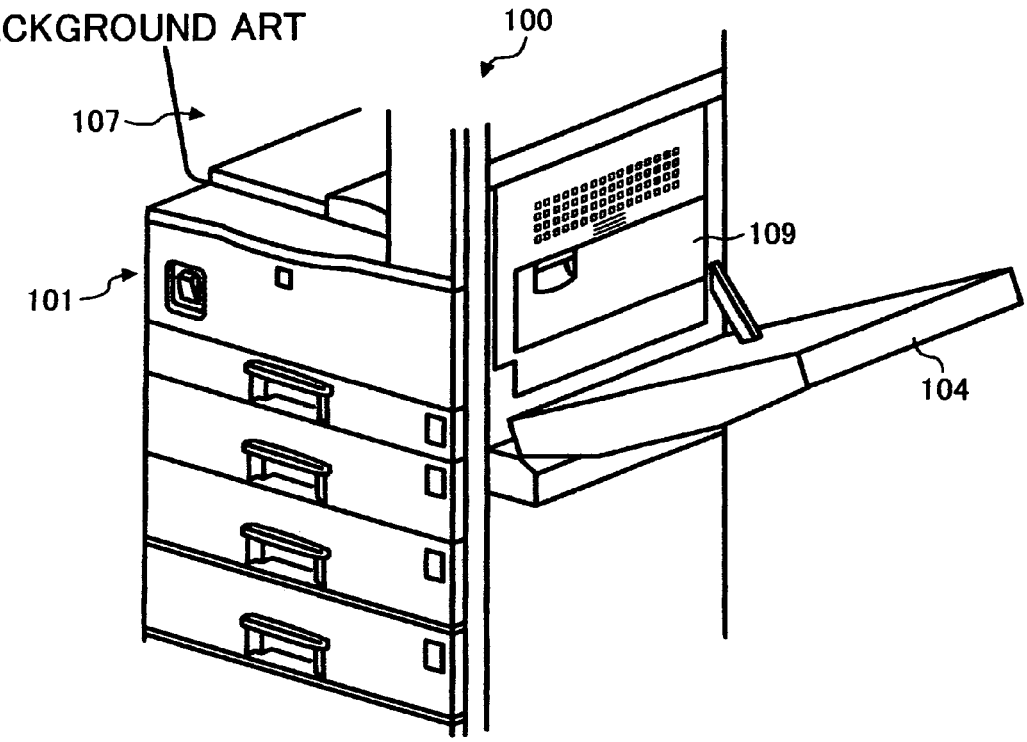
FIG. 2 BACKGROUND ART
FIG. 2 is the image forming apparatus of FIG. 1 when a duplex print unit is opened.
Figure 3:
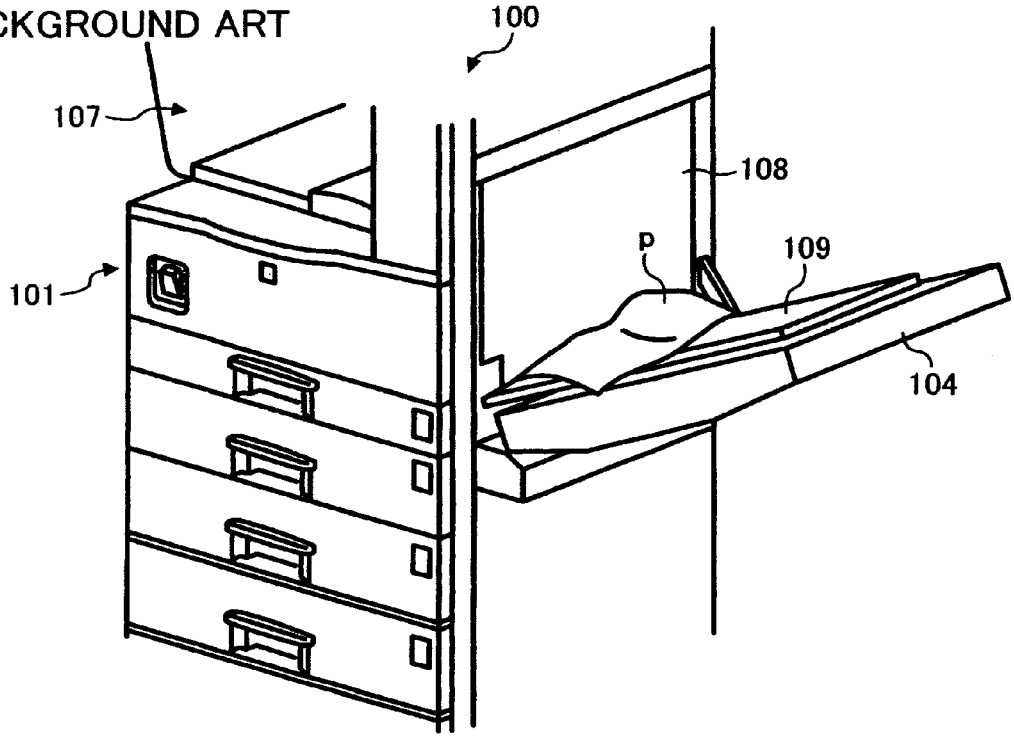
FIG. 3 BACKGROUND ART
FIG. 3 is the image forming apparatus of FIG. 1 when an inner cover is opened.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 4:
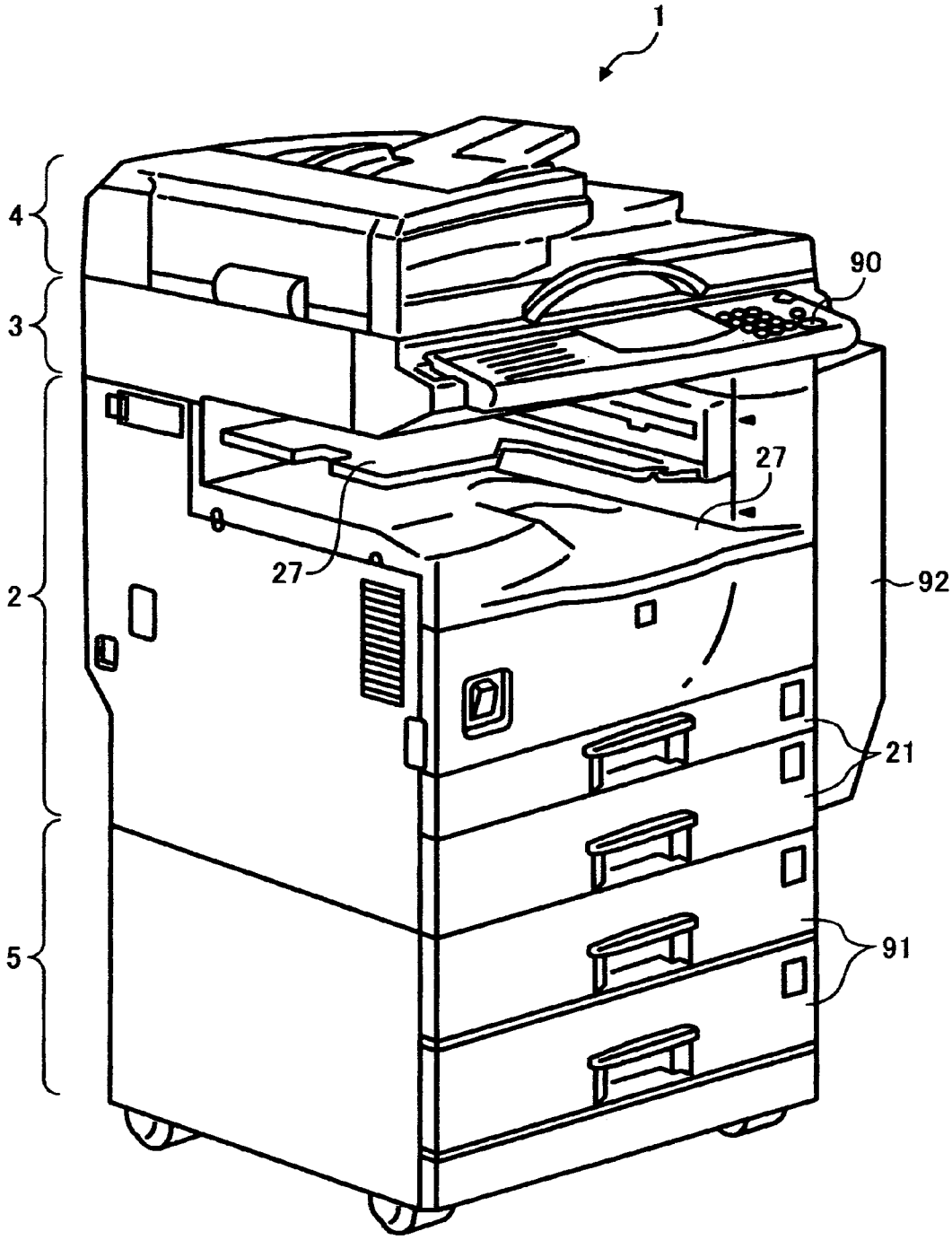
FIG. 4 is a schematic structure of an image forming apparatus according to an exemplary embodiment of the present invention.

Referring to FIG. 4, a schematic structure of an image forming apparatus 1 according to an embodiment of the present invention is described. The image forming apparatus 1 is a tandem-type electrophotographic image forming apparatus which includes an indirect transfer system.

The image forming apparatus 1 includes a main body 2 thereof, an image scanning mechanism 3, an automatic document feeder (ADF) 4, and an optional sheet feeding mechanism 5.

The main body 2 of the image forming apparatus 1 includes two sheet feeding cassettes 21, and sheet discharging trays 27. The sheet feeding cassettes 21 serve as a standard sheet feeding mechanism and are loaded with respective stacks of sheets of particular sizes including a recording sheet (not shown). The sheet discharging trays 27 receive the recording sheet discharged or conveyed from the main body 2. Details of the internal structure of the main body 2 will be described later, referring to FIG. 5.

A duplex print unit 92 is mounted as an open and close unit on the right side of the main body 2 of the image forming apparatus 1 in FIG. 4. Details of the duplex print unit 92 will be described later, referring to FIG. 5.

The image scanning mechanism 3 is arranged above the main body 2, and includes a contact glass (not shown), and a console display 90. The contact glass is mounted on the top of the image scanning mechanism 3. The console display 90 is mounted at the front portion of the image forming apparatus 1, substantially horizontally extending toward a front side where a user generally stands to use the image forming apparatus 1.

The ADF 4 is arranged above the image scanning mechanism 3. The ADF 4 is disposed to be capable of vertically and rotatably opening and closing about a horizontal shaft (serving as a supporting shaft) at a rear end thereof.

The optional sheet feeding mechanism 5 serves as an optional unit and supports the main body 2, the image scanning mechanism 3, and the ADF 4 thereon. The optical sheet feeding mechanism 5 includes two sheet feeding cassettes 91. The sheet feeding cassettes 91 are vertically disposed relative to each other, and are slidable to open at the front side of the optical sheet feeding mechanism 5 for loading and unloading recording sheets.

Figure 5:
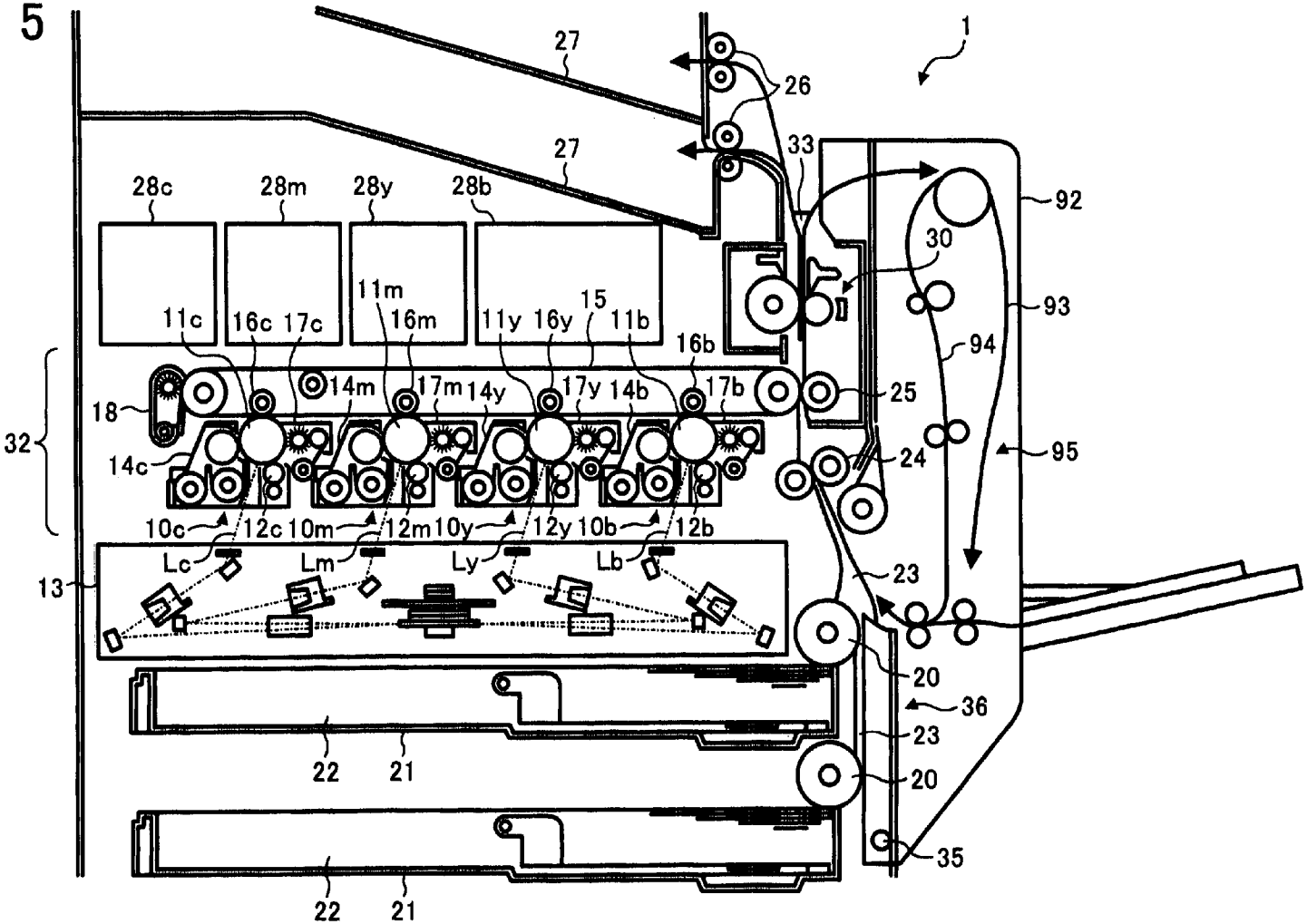
FIG. 5 is a schematic structure of a main body of the image forming apparatus of FIG. 4.

Referring to FIG. 5, a structure of an inner mechanism of the main body 2 of the image forming apparatus 1 shown in FIG. 4 is described.

The image forming apparatus 1 further includes an image forming mechanism 32, an optical writing unit 13, toner replenishing units 28*c*, 28*m*, 28*y*, and 28*bk*, and the standard sheet feeding mechanism including a sheet conveying part 36.

The image forming mechanism 32 includes image forming units 10*c*, 10*m*, 10*y*, and 10*bk*, an intermediate transfer member 15, primary transfer units 16*c*, 16*m*, 16*y*, and 16*bk*, a secondary transfer unit 25, primary cleaning units 17*c*, 17*m*, 17*y*, and 17*bk*, and a secondary cleaning unit 18.

The image forming units 10*c*, 10*m*, 10*y*, and 10*bk* are separately arranged at positions having horizontal heights or elevations forming a tandem-type image forming mechanism to form cyan images, magenta images, yellow images, and black images, respectively. The image forming units

10*c*, 10*m*, 10*y*, and 10*bk* respectively have drum-shaped image bearing members 11*c*, 11*m*, 11*y*, and 11*bk*, charging units 12*c*, 12*m*, 12*y*, and 12*bk*, and developing units 14*c*, 14*m*, 14*y*, and 14*bk*. The charging units 12*c*, 12*m*, 12*y*, and 12*bk*, and the developing units 14*c*, 14*m*, 14*y*, and 14*bk* are arranged around the respective image bearing members 11*c*, 11*m*, 11*y*, and 11*bk* in the respective image forming units 10*c*, 10*m*, 10*y*, and 10*bk*.

The image bearing members 11*c*, 11*m*, 11*y*, and 11*bk* rotate in a clockwise direction in FIG. 5.

The charging units 14*c*, 14*m*, 14*y*, and 14*bk* uniformly charge respective surfaces of the corresponding image bearing members 11*c*, 11*m*, 11*y*, and 11*bk*.

The optical writing unit 13 emits laser light beams Lc, Lm, Ly, and Lbk to irradiate respective surfaces of the corresponding image bearing members 11*c*, 11*m*, 11*y*, and 11*bk* to form respective electrostatic latent images on the respective surfaces thereof.

The developing units 14*c*, 14*m*, 14*y*, and 14*bk* supply respective color toners to the respective surfaces of the image bearing members 11*c*, 11*m*, 11*y*, and 11*bk* to visualize the respective electrostatic latent images formed on the respective surfaces of the image bearing members 11*c*, 11*m*, 11*y*, and 11*bk* as respective single toner images. The respective developing units 14*c*, 14*m*, 14*y*, and 14*bk* contain the different colored toners supplied by the toner replenishing units 28*c*, 28*m*, 28*y*, and 28*bk*.

The single toner images formed on the respective surfaces of the image bearing members 11*c*, 11*m*, 11*y*, and 11*bk* are transferred onto a surface of the intermediate transfer member 15 to form an overlaid full color toner image.

The intermediate transfer member 15 is disposed above the image forming units 10*c*, 10*m*, 10*y*, and 10*bk*. The intermediate transfer member 15 is an endless belt rotating in a counterclockwise direction in FIG. 5. The intermediate transfer member 15 is held in contact with the primary transferring units 16*c*, 16*m*, 16*y*, and 16*bk* disposed inside a loop of the intermediate transfer member 15 to face the respective image bearing members 11*c*, 11*m*, 11*y*, and 11*bk*, which are accommodated in the image forming units 10*c*, 10*m*, 10*y*, and 10*bk*, respectively.

The primary transfer units 16*c*, 16*m*, 16*y*, and 16*bk* form respective primary transfer portions to perform a primary transfer operation. In the primary transfer operation, the respective single toner images formed on respective surfaces of the image bearing members 11*c*, 11*m*, 11*y*, and 11*bk* are sequentially transferred onto the surface of the intermediate transfer member 15 that is previously charged. By transferring the respective single toner images, the overlaid full color toner image is formed on the surface of the intermediate transfer member 15.

While the image forming mechanism 32 is forming the above-described color toner image, a recording medium such as a recording sheet is fed from one of the sheet feeding cassettes 21 in the standard sheet feeding mechanism of the image forming apparatus 1.

The standard sheet feeding mechanism including the sheet conveying part 36 includes the sheet feeding cassettes 21, the recording medium or recording sheet 22, sheet feeding rollers 20, a recording sheet conveying path 23, and a pair of registration rollers 24.

The image forming apparatus 1 selects one of the sheet feeding cassettes 21 of the main body 2 or the sheet feeding cassettes 91 of the optional sheet feeding mechanism 5 to feed the recording medium 22 therefrom. The image forming apparatus 1 selectively rotates the sheet feeding roller 20 at a predetermined timing to feed the recording sheet 22, and conveys the recording sheet 22 through the recording sheet conveying path 23 toward the pair of registration rollers 24. The recording sheet conveying path 23 passes the recording sheet 22 therethrough. The pair of registration rollers 24 supplies the recording sheet 22 in synchronization with respective movement of the image forming mechanism 32 so that the secondary transfer unit 25 may transfer the full color image formed on the intermediate transfer member 15 onto a proper position of the recording sheet 22. The full color toner image on the recording sheet 22 is then conveyed upward through the recording sheet conveying path 23 to be fixed by a fixing unit 30 through application of heat and pressure. The recording sheet 22 having the fixed full color image is conveyed by sheet discharging rollers 26 and is discharged to one of the sheet discharging trays 27 arranged on the top portion of the main body 2 of the image forming apparatus 1.

After the respective single toner images formed on the respective surfaces of the image bearing members 11*c*, 11*m*, 11*y*, and 11*bk* are transferred onto the surface of the intermediate transfer member 15, respective color toners remaining on the image bearing members 11*c*, 11*m*, 11*y*, and 11*bk* are removed by the primary cleaning units 17*c*, 17*m*, 17*y*, and 17*bk*, respectively.

After the full color toner image is transferred onto the recording sheet 22, residual toner on the intermediate transfer member 15 is removed by the secondary cleaning unit 18.

When a duplex print operation is performed to form images on respective sides of the recording sheets 22 in the image forming apparatus 1 of FIG. 5, the recording sheet 22 may pass through the duplex print unit 92. The duplex print unit 92 includes a switchback path 93, a reverse sheet conveying path 94, a recording medium conveying system 95, and a horizontal shaft 35.

After the fixing unit 30 fixes the recording sheet 22 having an image on one side of the recording sheet 22, the recording sheet 22 is conveyed toward a path selector 33. The path selector 33 may be switched to allow the recording sheet 22 to go to the duplex print unit 92. When the duplex print unit 92 receives the recording sheet 22, the switchback path 93 reverses the recording sheet 22 to the different surface side orientation. The reversed recording sheet 22 is then conveyed through the reverse sheet conveying path 94 to a secondary transfer area formed between the intermediate transfer member 15 and the secondary transfer unit 25 of the main body 2 so that a next full color toner image can be transferred onto the rear surface of the recording sheet 22. Then, the recording sheet 22 having full color toner images printed on the front and rear sides is conveyed via the fixing unit 30 to one of the sheet discharging trays 27 by the corresponding sheet discharging rollers 26.

Figure 6:
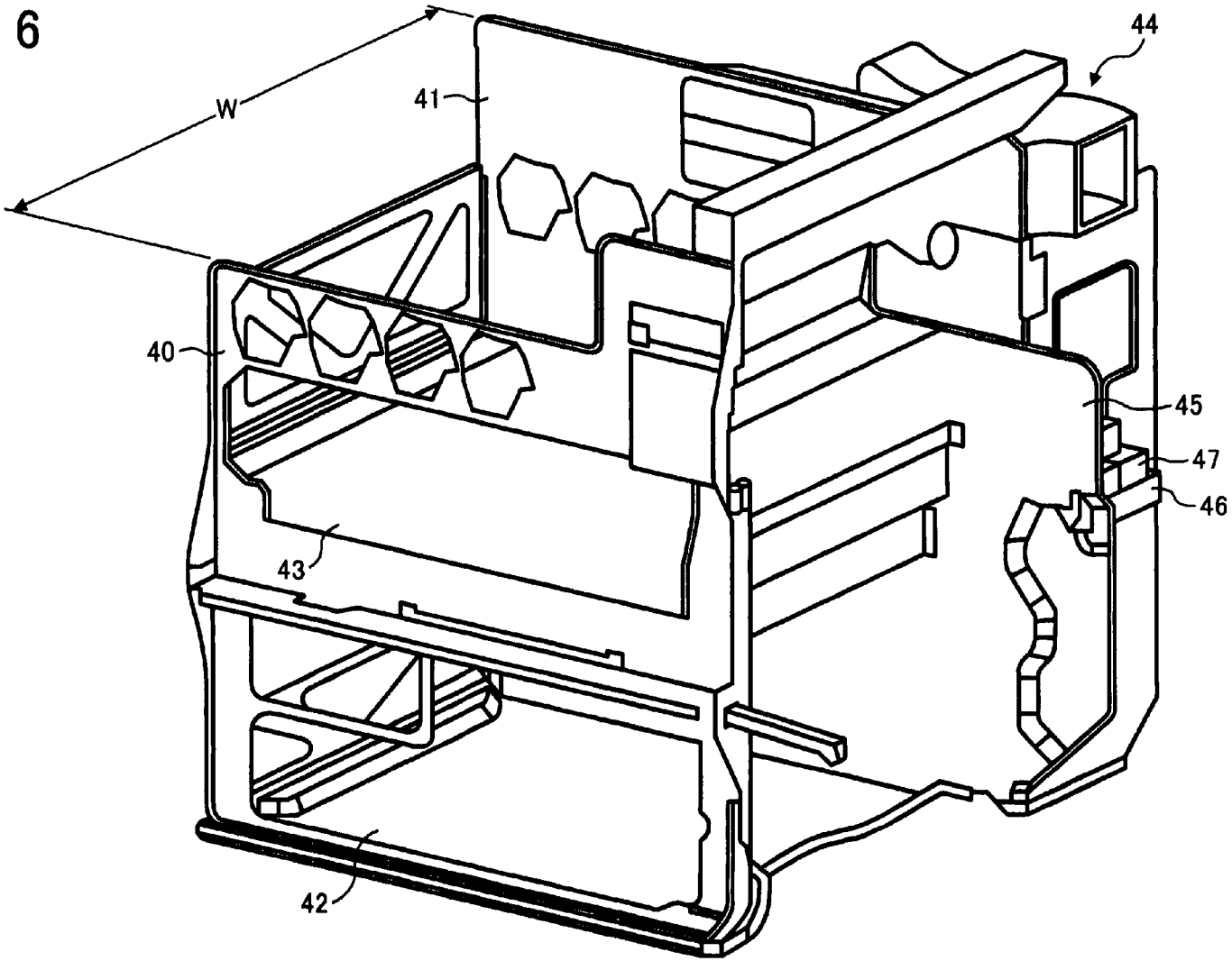
FIG. 6 is a schematic structure of a frame structure included in the image forming apparatus.
Figure 7:
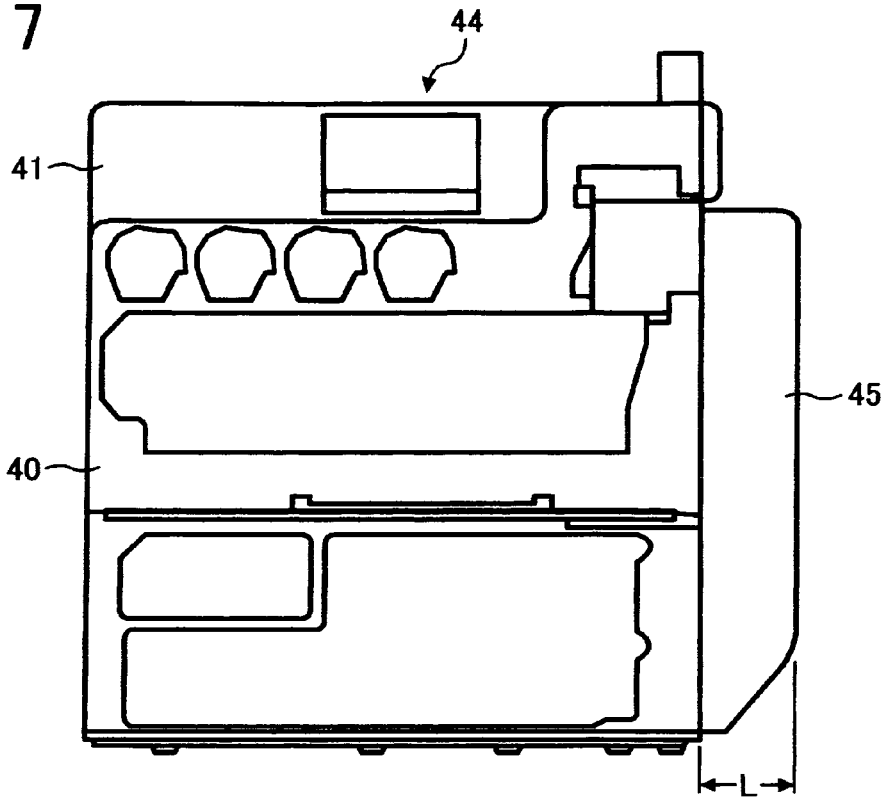
FIG. 7 is a front view of the schematic structure of FIG. 6.

Referring to FIGS. 6 and 7, a schematic frame structure 44 of the image forming apparatus 1 is described.

A pair of frame plates of front and rear frame plates 40 and 41 are mounted to the main body 2 in the image forming apparatus 1. The front and rear frame plates 40 and 41 are disposed facing each other and spaced apart, having a width W between them as shown in FIG. 6.

The front frame plate 40 is disposed at the front side of the image forming apparatus 1, and the rear frame plate 41 is disposed at the rear side of the image forming apparatus 1. As previously described, the front side is the nearest side to where a user or operator stands when the user operates the image forming apparatus 1. Conversely, the rear side is the farthest side from the user. The front and rear frame plates 40 and 41 are engaged with a bottom plate 42 and an intermediate plate 43 to form the frame structure 44 as shown in FIG. 6. The front and rear frame plates 40 and 41 support the image forming mechanism 32 including the image forming units 10*c*, 10*m*, 10*y*, and 10*bk*, the intermediate transfer member 15, the primary transfer units 16*c*, 16*m*, 16*y*, and 16*bk*, the secondary cleaning unit 18, the secondary transfer unit 25, and the like, so that the image forming mechanism 32 may be mounted to the frame structure 44.

The image forming mechanism 32 of FIG. 6 employs an indirect transfer method with the tandem type electrophotographic image forming apparatus. However, the image forming mechanism is not limited to be used in the above-described image forming apparatus. For example, an embodiment of the present invention can be an image forming apparatus using a direct transfer method or a single image bearing member.

As shown in FIG. 7, the rear frame plate 41 has a portion horizontally extended to the right side by a length L, compared with the front frame plate 40. The portion extended by the length L is defined as an extended portion 45 (shown in FIGS. 6 and 7) of the rear frame plate 41.

The rear frame plate 41 may support drive motors 46 and 47, shown in FIG. 6. Details of the drive motors 46 and 47 will be described later. The extended portion 45 protrudes at the right side of the main body 2 of the image forming apparatus 1 and forms an area with the length L and the width W. The duplex print unit 92 is rotatably mounted within the area of the extended portion 45 with respect to the main body 2 of the image forming apparatus 1, as shown in FIG. 7.

Figure 8:
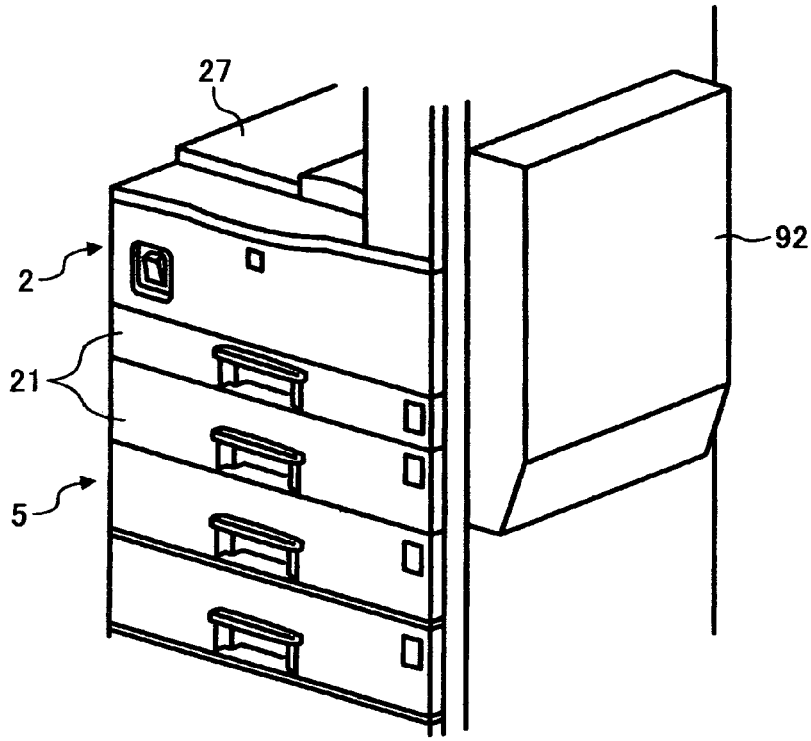
FIG. 8 is a perspective view of the main body when a duplex print unit is closed.
Figure 9:
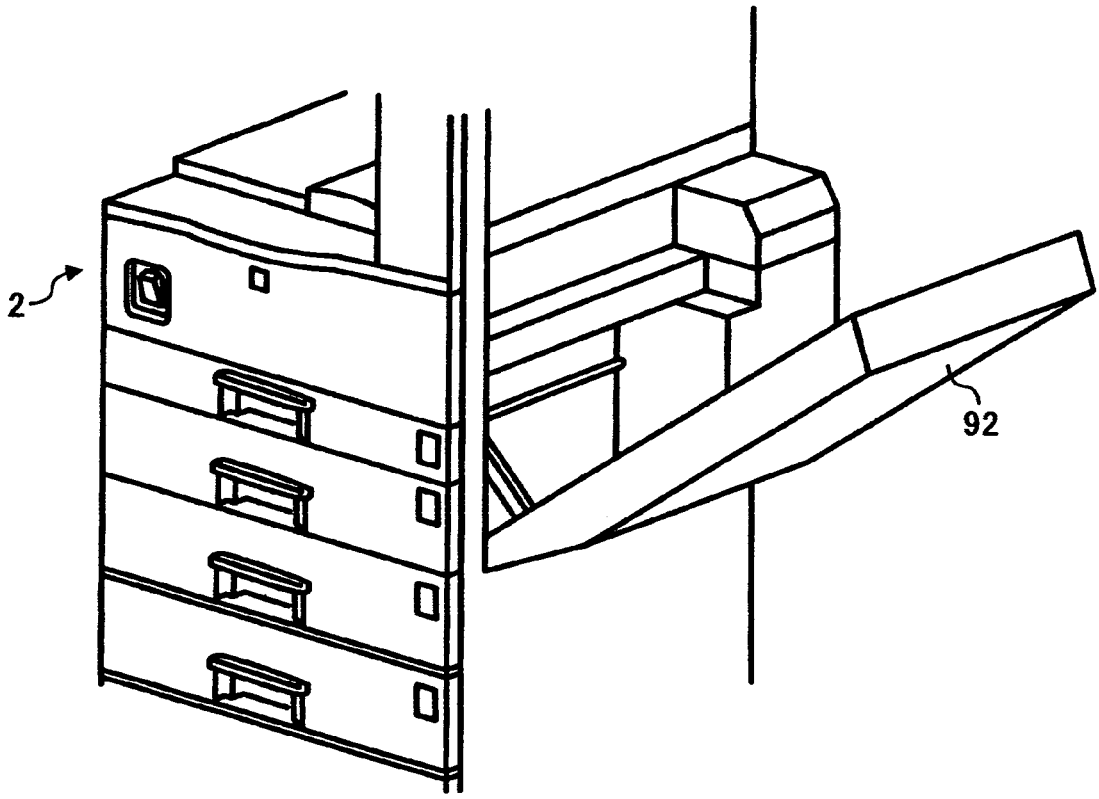
FIG. 9 is a perspective view of the main body when the duplex print unit is opened.

Referring to FIGS. 8 and 9, the detailed structure of the duplex print unit 92 is described.

The duplex print unit 92 may pivotably open and close in a vertical manner around the horizontal shaft 35 as shown in FIG. 8.

Referring back to FIG. 5, the duplex print unit 92 is mounted at a point proximately outside the recording sheet conveying path 23 included in the main body 2 of the image forming apparatus 1. When a paper jam occurs, a jammed paper stuck in the recording sheet conveying path 23 may easily be removed by opening the duplex print unit 92 serving as an open and close unit. The duplex print unit 92 may be opened as shown in FIG. 9. Opening the duplex print unit 92 may widely expose the sheet conveying part 36 of the main body 2 of the image forming apparatus 1, which allows the user to easily remove the jammed paper from the recording sheet conveying path 23.

Figure 10:
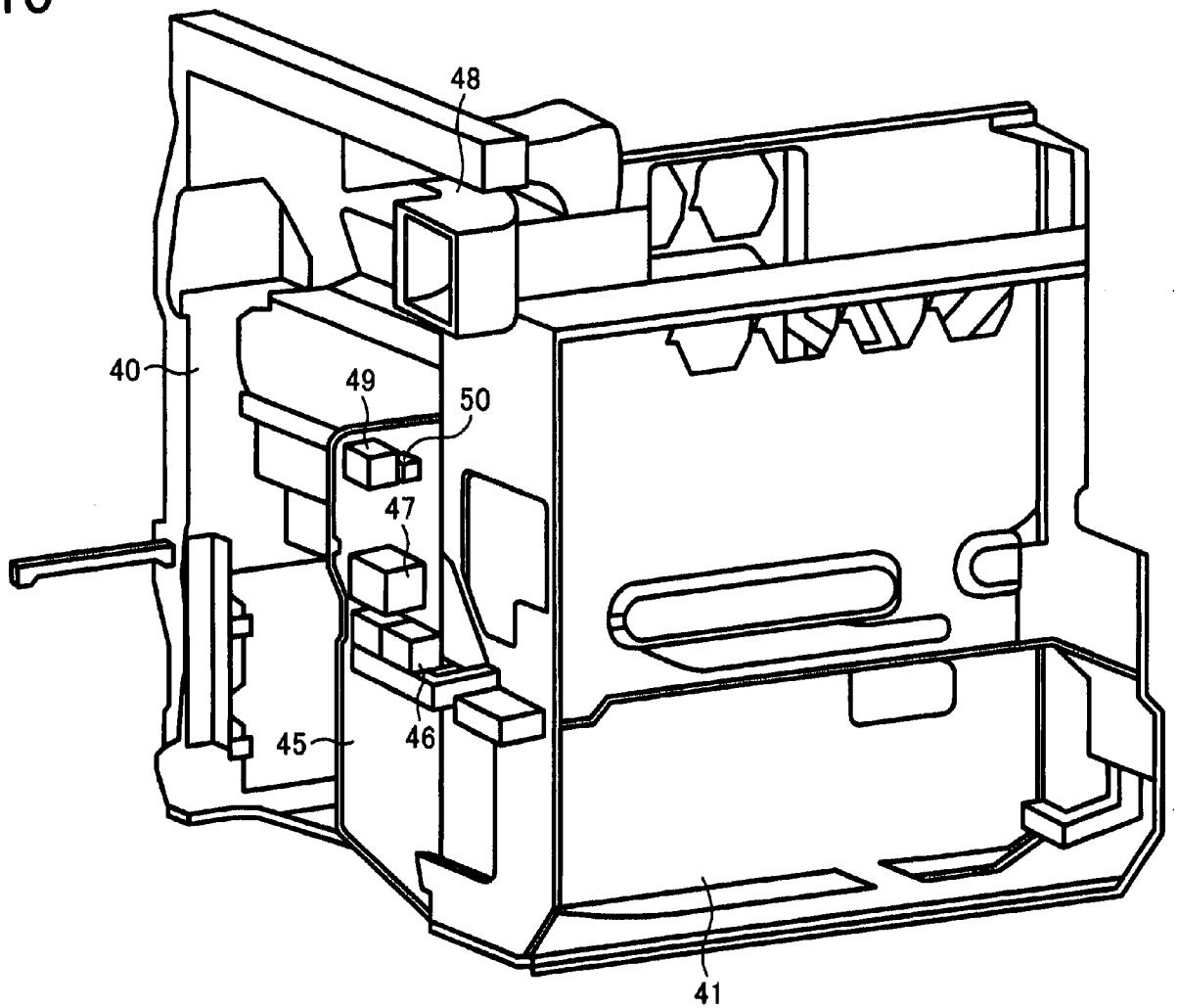
FIG. 10 is a perspective view with an extended portion of a frame plate supporting a drive motor.

Referring now to FIG. 10, the extended portion 45 of the rear frame plate 41 is described.

As described above, the duplex print unit 92 includes the recording medium conveying system 95 for reversing the recording sheet 22 so that the recording sheet 22 may repeatedly be supplied to the image forming mechanism 32. The extended portion 45 of the rear frame plate 41 may support a portion of a drive controlling mechanism that is configured to control the recording medium conveying system 95 to drive. That is, the portion of the drive controlling mechanism may separately be mounted on the extended portion 45 of the rear frame plate 41. The drive controlling mechanism includes the drive motor 46, a solenoid 49, and a detecting member 50. The drive motor 46 drives a conveying member such as rollers and belts included in the recording medium conveying system 95. The solenoid 49 switches a switching member such as the path selector 33 for switching or selecting the direction of the recording medium. The detecting member 50 detects the recording sheet 22 during the travel of the recording sheet 22. The drive motor 47 in FIG. 10 drives the pair of registration rollers 24. A duct outlet 48 is disposed at the upper portion of the extended portion 45 in an outwardly extending manner.

Operations of removing a jammed paper are described below.

When the user wants to remove the jammed paper from the image forming apparatus 1 with the drive motor 46 separately mounted on the extended portion 45, the duplex print unit 92 serving as the open and close unit is rotated around the horizontal shaft 35 to be opened outwardly as shown in FIG. 9. The user may insert his or her hand(s) inside the main body 2 of the image forming apparatus 1 from the front side of the image forming apparatus 1, remove the jammed paper stuck in the recording sheet conveying path 23, and close the duplex print unit 92 as shown in FIG. 8.

Figure 11:
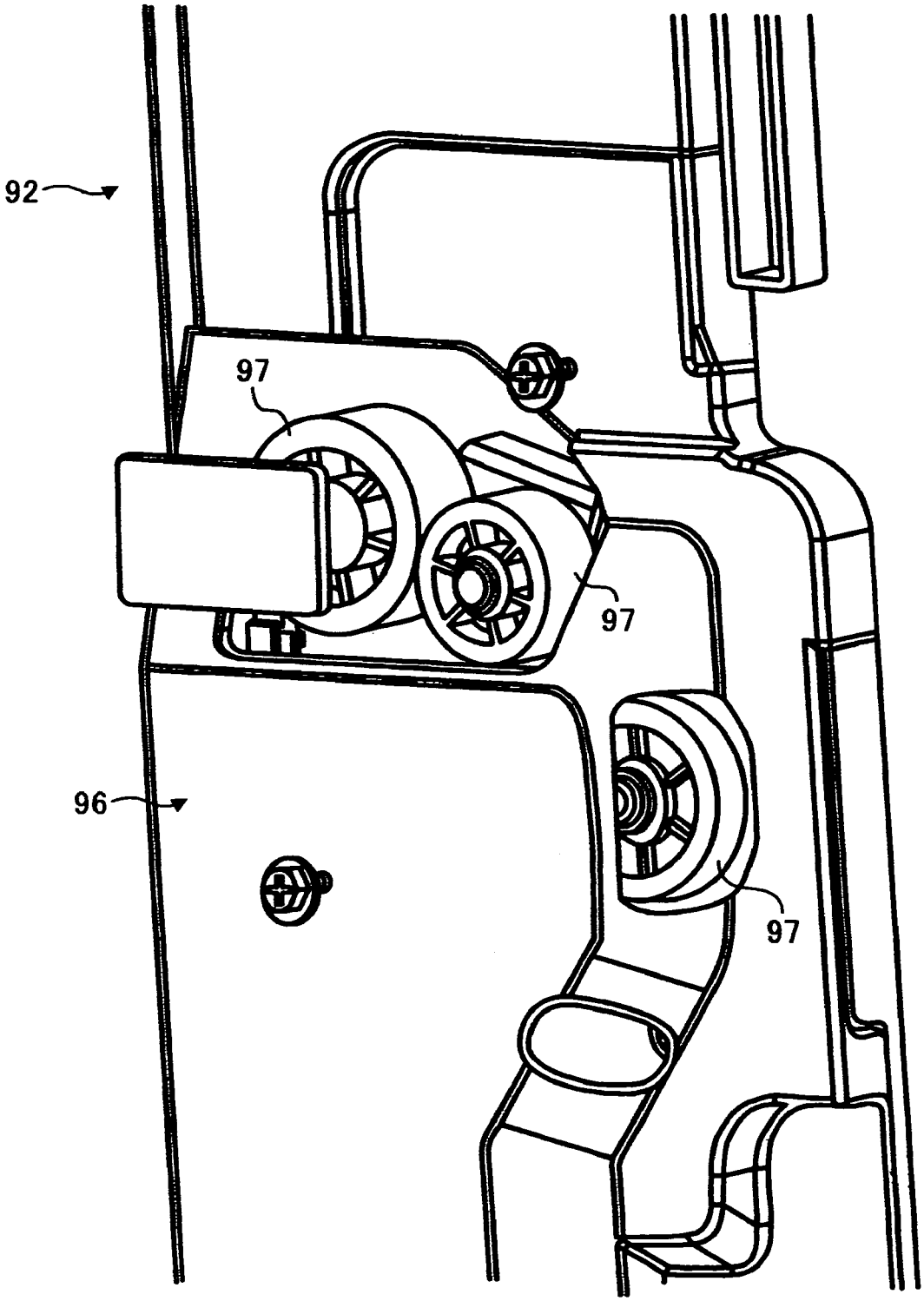
FIG. 11 is an enlarged view of a portion of the duplex print unit.

Referring to FIG. 11, a detailed structure of the duplex print unit 92 is described.

As shown in FIG. 11, the duplex print unit 92 includes a drive force transmission unit 96 mounted on the extended portion 45 of the rear frame plate 41. The drive force transmission unit 96 includes a plurality of gears 97. When the duplex print unit 92 is closed, a motor gear of the drive motor 46 supported by the extended portion 45 may engage with one of the plurality of gears 97 of the drive force transmission unit 96 so that drive force of the drive motor 46 may be transmitted to the conveying member such as the rollers and belts of the recording medium conveying system 95 to rotate the conveying member and convey the recording sheet 22. When the duplex print unit 92 is opened, the motor gear of the drive motor 46 may be disengaged from one of the plurality of gears of the drive force transmission unit 96.

As described above, the drive motor 46 is separated from the duplex print unit 92 and is mounted on the rear frame plate 41 of the main body 2 of the image forming apparatus 1, and the duplex print unit 92 without the drive motor 46 thereon is opened and closed with respect to the main body 2 of the image forming apparatus 1. By providing the drive motor 46 separately from the duplex print unit 92, the structure of the duplex print unit 92 may not be complicated to avoid increasing its cost. The duplex print unit 92 having the above-described structure may also be made smaller, thereby increasing operability of opening and closing the duplex print unit 92 when the paper jam occurs. Further, the duplex print unit 92 may not be connected to harnesses, thereby increasing reliability of the image forming apparatus 1.

In the exemplary embodiment, the front and rear frame plate 40 and 41 are disposed opposite to each other at the front and rear side of the image forming apparatus 1, and the duplex print unit 92 serving as the open and close unit is disposed at the right-hand side of the main body 2 of the image forming apparatus 1. As an alternative, a pair of frame plates may be disposed opposite to each other at the right-hand and left-hand sides of the image forming apparatus 1, and an open and close unit may be disposed at the front or rear side of the main body 2 of the image forming apparatus 1. Further, the horizontal shaft 35 is not limited to rotate the duplex print unit 92. For example, the duplex print unit 92 may be rotated around a vertical shaft.

When the vertical shaft is disposed at the right-hand or left-hand side of the main body 2 of the image forming apparatus 1, the duplex print unit 92 may open toward the front and/or rear side of the image forming apparatus 1. When the vertical shaft is disposed at the front or rear side of the main body 2 of the image forming apparatus 1, the duplex print unit 92 may open toward the right-hand and/or left-hand side of the image forming apparatus 1.

By forming the front frame plate 40 to be smaller than the rear frame plate 41, the paper jam may easily be addressed. That is, when the duplex print unit 92 is opened, the user may smoothly insert his or her hand(s) from the front side of the image forming apparatus 1 to easily remove the jammed paper.

By providing the extended portion 45 for the rear frame plate 41 of the image forming apparatus 1, the duplex print unit 92 may be disposed at the extended portion 45. That is, when the duplex print unit 92 is opened, the inside of the image forming apparatus 1 may be widely exposed in the vicinity of the outer portion of the image forming apparatus 1, and the user may insert his or her hand(s) from the front side of the image forming apparatus 1 more smoothly to remove the jammed paper more easily.

In the exemplary embodiment described above, the open and close unit, i.e., the duplex print unit 92, opens and closes for performing the paper jam operation. However, the open and close unit is not limited to the above-described duplex print unit and/or is not limited for performing the paper jam operation. The embodiment of the present invention can be an open and close unit to be opened and closed for the purpose of replacement of parts or consumables, repair, and/or maintenance.

When recording images on the front and rear side of the recording sheet 22 by using the duplex print unit 92, the recording sheet 22 having an image on one side is conveyed to the duplex print unit 92 to be reversed such that the recording sheet 22 may be supplied to the image forming mechanism 32 again.

When the paper jam operation is performed, the portion of the drive controlling mechanism for controlling the recording medium conveying system 95 may be supported by the extended portion 45 separately from the duplex print unit 92, and the duplex print unit 92 may be opened and closed with respect to the main body 2 of the image forming apparatus 1.

By simply providing the portion of the drive controlling mechanism separately from the duplex print unit 92 that is relatively heavy, the duplex print unit 92 is less complicated in the structure and its cost can be reduced. Further, the duplex print unit 92 may be made smaller or more compact to increase operability of opening and closing in addressing the paper jam. Furthermore, the duplex print unit 92 may have increased reliability such that the open and close unit may not be connected to harnesses.

When the paper jam removing operation is performed, the duplex print unit 92 is opened to release the recording sheet conveying path 23 disposed right inside thereof. Since the recording sheet conveying path 23 is widely exposed, the user can easily remove the jammed paper stuck in the recording sheet conveying path 23.

The front and rear frame plates 40 and 41 may also be integrated as a single piece of the frame structure 44 including a resin material. Compared with a frame structure including a metal material, the above-described frame structure 44 may decrease the weight of the main body 2 of the image forming apparatus 1, resulting in reduction of costs. Further, the front and rear frame plates 40 and 41 formed as a single piece may easily be mounted with respect to the image forming apparatus 1.

The above-described embodiments show the open and close unit, i.e., the duplex print unit 92 rotating around the horizontal or vertical shaft serving as a supporting point so that the duplex print unit 92 opens and closes with respect to the main body 2 of the image forming apparatus 1. Alternatively, the open and close unit may be opened and closed by detaching from the image forming apparatus 1. Furthermore, the open and close unit may be opened and closed by sliding or horizontally moving with respect to the image forming apparatus 1. Even in these cases, by supporting the drive motor 46 at the extended portion 45, operability in opening and closing the open and close unit may be improved.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. An image forming apparatus, comprising:

first and second frame plates oppositely disposed facing each other, spaced apart by a predetermined width from each other, and supporting an image forming mechanism, the second frame plate comprising an extended portion horizontally extending by a predetermined length beyond the first frame plate;

an open and close unit disposed within an area of the extended portion between the first and second frame plates and configured to freely open and close with respect to the image forming apparatus, the open and close unit comprising a recording medium conveying system configured to convey a recording medium; and a drive controlling mechanism configured to control the recording medium conveying system, wherein the extended portion supports at least a portion of the drive controlling mechanism so as to be separately mounted from the open and close unit on a side of the image forming apparatus.

2. The image forming apparatus according to claim 1, wherein:

the first frame plate comprises a front frame plate disposed at a front side of the image forming apparatus; and the second frame plate comprises a rear frame plate disposed at a rear side of the image forming apparatus, the rear frame plate comprising the extended portion horizontally extending by the predetermined length compared with the front frame plate.

3. The image forming apparatus according to claim 2, wherein:

the extended portion of the rear frame plate is horizontally extended to mount the open and close unit with respect to the image forming apparatus.

4. The image forming apparatus according to claim 3, wherein:

the recording medium conveying system compnses a conveying member configured to convey the recording medium, and the portion of the drive controlling mechanism includes a driving source configured to rotatably drive the conveying member.

5. The image forming apparatus according to claim 3, wherein:

the recording medium conveying system comprises a switching member configured to switch a direction of travel of the recording medium, and the portion of the drive controlling mechanism includes a solenoid configured to drive the switching member.

6. The image forming apparatus according to claim 3, wherein:

the portion of the drive controlling mechanism includes a detecting member configured to detect the recording medium conveyed to the recording medium conveying system.

7. The image forming apparatus according to claim 1, wherein:

the open and close unit includes a duplex print unit.

8. The image forming apparatus according to claim 1, further comprising a recording medium conveying path configured to pass the recording medium therethrough, wherein the open and close unit is disposed at a point proximate to the recording medium conveying path.

9. The image forming apparatus according to claim 8, wherein:

the open and close unit is rotatably disposed on a shaft.

10. The image forming apparatus according to claim 1, further comprising a sheet feeding cassette including a sheet conveying part, wherein the sheet conveying part is exposed to an outside of the image forming apparatus when the open and close unit is opened.

11. The image forming apparatus according to claim 1, wherein:

the first and second frame plates are formed of a resin material molded in one piece.

12. An image forming apparatus, comprising:

first means for supporting elements of the image forming apparatus;

second means for supporting elements of the image forming apparatus, and comprising an extended portion horizontally extending by a predetermined length beyond the first means for supporting, the first and second means for supporting being spaced apart by a predetermined width from each other facing each other, and supporting an image forming mechanism;

means for opening and closing freely with respect to the image forming apparatus, the means for opening and closing disposed within an area of the extended portion between the first and second means for supporting, and comprising means for conveying a recording medium; and means for controlling the means for conveying, wherein the extended portion supports at least part of the means for controlling so as to be separately mounted on a side of the image forming apparatus.

13. The image forming apparatus, according to claim 12, wherein:

the first means for supporting comprises a front frame plate disposed at a front side of the image forming apparatus; and the second means for supporting comprises a rear frame plate disposed at a rear side of the image forming apparatus, the rear frame plate comprising the extended portion horizontally extending by the predetermined length compared with the front frame plate.

14. The image forming apparatus according to claim 13, wherein:

the extended portion of the rear frame plate is horizontally extended to mount the means for opening and closing with respect to the image forming apparatus.

15. The image forming apparatus according to claim 14, wherein:

the means for conveying comprises a conveying member configured to convey the recording medium, and the means for controlling comprises a driving source configured to rotatably drive the conveying member.

16. The image forming apparatus according to claim 14, wherein:

the means for conveying comprises a switching member configured to switch the direction of the recording medium, and the means for controlling comprises a solenoid configured to drive the switching member.

17. The image forming apparatus according to claim 14, wherein:

the means for controlling includes a detecting member configured to detect the recording medium conveyed to the means for conveying.

18. The image forming apparatus according to claim 12, wherein:

the means for opening and closing includes a duplex print unit.

19. The image forming apparatus according to claim 12, further comprising means for passing the recording medium therethrough, wherein the means for opening and closing is disposed at a point proximate to the means for passing.

20. The image forming apparatus according to claim 19, wherein:

the means for opening and closing is rotatably disposed on a shaft.

21. The image forming apparatus according to claim 12, further comprising means for feeding the recording medium including a sheet conveying part, wherein the means for feeding is exposed to an outside of the image forming apparatus when the means for opening and closing is opened.

22. The image forming apparatus according to claim 12, wherein:

the first and second means for supporting are formed of a resin material molded in one piece.

23. A method of mounting an open and close unit on an image forming apparatus, comprising:

disposing first and second frame plates oppositely facing each other spaced apart by a predetermined width from each other, and supporting an image forming mechanism, the second frame plate comprising an extended portion horizontally extending by a predetermined length beyond the first frame plate;

mounting an open and close unit within an area of the extended portion between the first and second frame plates and configured to freely open and close with respect to the image forming apparatus, the open and close unit comprising a recording medium conveying system configured to convey a recording medium; and mounting at least a portion of a drive controlling mechanism configured to control the recording medium conveying system so that the portion of the drive controlling mechanism is supported separately from the open and close unit.

24. The method according to claim 23, further comprising:

disposing the open and close unit proximate to a recording medium conveying path of the image forming apparatus.

* * * * *